US006967189B2

(12) United States Patent
Li et al.

(10) Patent No.: US 6,967,189 B2
(45) Date of Patent: Nov. 22, 2005

(54) BUFFERED LUBRICANT FOR CONVEYOR SYSTEM

(75) Inventors: Minyu Li, Oakdale, MN (US); Paul J. Wang, Woodbury, MN (US); Lawrence A. Grab, Woodbury, MN (US)

(73) Assignee: Ecolab Inc., St. Paul, MN (US)

( * ) Notice: Subject to any disclaimer, the term of this patent is extended or adjusted under 35 U.S.C. 154(b) by 112 days.

(21) Appl. No.: 10/306,671

(22) Filed: Nov. 27, 2002

(65) Prior Publication Data

US 2004/0102334 A1 May 27, 2004

(51) Int. Cl.[7] ..... C10M 141/02; C10M 173/02

(52) U.S. Cl. ..... 508/180; 508/250; 508/459; 508/506; 508/552; 508/579

(58) Field of Search ..... 508/180

(56) References Cited

U.S. PATENT DOCUMENTS

| | | | | |
|---|---|---|---|---|
| 2,825,693 | A | 3/1958 | Beaubien et al. | 508/174 |
| 3,350,346 | A | 10/1967 | Maxson | 524/161 |
| 3,352,787 | A | 11/1967 | Bodach | 134/42 |
| 3,372,117 | A | 3/1968 | Jones et al. | 508/164 |
| 3,374,171 | A | 3/1968 | Davis | 508/158 |
| 3,574,100 | A | 4/1971 | Wetmore | 508/285 |
| 3,583,914 | A | 6/1971 | Garvin et al. | 508/245 |
| 3,672,977 | A | 6/1972 | Dardoufas | 428/395 |
| 3,700,013 | A | 10/1972 | Coffey et al. | 106/2 |
| 3,718,588 | A | 2/1973 | Bellos | 508/424 |
| 3,826,746 | A | 7/1974 | Schick et al. | 508/266 |
| 3,860,521 | A | 1/1975 | Aepli et al. | 508/438 |
| 3,950,258 | A | 4/1976 | Imai et al. | 508/250 |
| 3,955,005 | A | 5/1976 | Trelease et al. | 426/310 |
| 4,062,785 | A | 12/1977 | Nibert | 508/211 |

(Continued)

FOREIGN PATENT DOCUMENTS

| | | | |
|---|---|---|---|
| AU | A-73074/94 | | 4/1996 |
| DE | 19642598 | A | 8/1999 |
| EP | 14238 | | 8/1980 |
| EP | 0 137 057 | | 4/1985 |
| EP | 245928 | A | 11/1987 |
| EP | 283893 | A1 | 9/1988 |
| EP | 0 302 705 | | 2/1989 |
| EP | 0 329 891 | | 8/1989 |
| EP | 0 359 330 | | 9/1989 |
| EP | 530861 | A | 3/1993 |
| EP | 614660 | A1 | 9/1994 |
| EP | 0 735 127 | A1 | 2/1996 |
| JP | 02097593 | A2 | 4/1990 |
| JP | 08151328 | A | 6/1996 |
| JP | 08333592 | A | 12/1996 |
| WO | WO 92/13048 | A1 | 8/1992 |
| WO | WO 92/13049 | | 8/1992 |
| WO | WO 92/13050 | A1 | 8/1992 |
| WO | WO 93/18120 | A1 | 9/1993 |
| WO | WO 93/18121 | | 9/1993 |
| WO | WO 94/20578 | A1 | 9/1994 |
| WO | WO 95/20319 | | 8/1995 |
| WO | WO 97/45509 | A1 | 12/1997 |
| WO | WO 01/12759 | | 2/2001 |
| WO | WO 01/30946 | A1 | 5/2001 |
| ZA | 9006002 | A | 6/1991 |

OTHER PUBLICATIONS

BASF brochure entitled "Pluronic & Tetronic Block Copolymer Surfactants".

Batterson, J. and Entrup, M., "Preservative Efficacy Study", *Whitmore Manufacturing Company,* 4 pgs. (Aug. 2, 1993).

"Bel–Ray Total Performance Lubricants "World Class" Worldwide", http://belray.com/industrial/industrial.htm, 4 pgs. (Printed Jan. 14, 1999).

Brittain, D., Technical Document entitled "BECKER"—Lubricating Oils for Becker Dekatorr Pumps—Part I: Understanding and Selecting, http://www.beckerpump-s.com/tdl.htm. from *The Edge,* No. 5, 2 pgs. (1995).

"Chemical Preservatives", *Food Microbiology Fundamentals and Frontiers,* edited by Doyle, M. et al., pp. 528–534 (Date unknown).

"Cleaning and Sanitizing of Plant and Equipment in the Egg Handling and Processing Industry", *Australian Standard,* 35 pp., Abstract only (1987).

Dallyn, H. "Antimicrobial Properties of Vegetable and Fish Oils", *Natural Antimicrobial Systems and Food Preservation,* CAB International: Wallingford, England, UK, Abstract (1994).

Declaration of Joel James Schilling dated Aug. 3, 2000.

Dillon, V.M. et al., "Natural Antimicrobial Systems and Food Preservation", CAB International: Wallingford, England, UK, Abstract (1994).

"Food Additives. Sanitizing Solutions", *Federal Register,* pp. 53001–53002, Abstract only (Dec. 3, 1976).

"Food Machinery Lubricants", *Vulcan Ecolab,* 5 pages. (Date unknown).

"Improved Food Grade Lubricants Contain Antimicrobial Agent", Source unknown, 1 pg. (Date unknown).

Straka, A., "Chemicals to Use for Cleaning and Sanitizing", *Independent Restaurants,* vol. 48, No. 10, p. 42, Abstract only (Oct. 1986).

Technical Data Sheet entitled Whitmores's—Medallion™ *FM Grease,* 4 pgs. (printed Jan. 14, 1999).

"Whitemore's Technical Data Sheet—Medallion™ Food Machinery Grease", http://www.whitemore.com/Tech DataSh . . . edFMGrease.htm, 4 pgs., (printed Jan. 14, 1999).

*Primary Examiner*—Ellen M. McAvoy
(74) *Attorney, Agent, or Firm*—Andrew D. Sorensen; Anneliese M. Seifert

(57) ABSTRACT

A method of lubricating a moving surface is herein described wherein the lubricant composition contains a fatty acid, a neutralization agent, a pH buffer, and a carrier. Also described are compositions in both concentrate and dilute form. The compositions may also comprise additional functional ingredients.

26 Claims, No Drawings

U.S. PATENT DOCUMENTS 4,067,997 A 1/1978 Kabara ..... 514/552
4,088,585 A 5/1978 Karpen ..... 508/141
4,274,973 A 6/1981 Stanton et al. ..... 508/459
4,289,671 A 9/1981 Hernandez ..... 524/275
4,381,293 A 4/1983 Michel ..... 424/401
4,414,121 A 11/1983 Aiello ..... 508/178
4,436,200 A 3/1984 Hodlewsky et al. ..... 198/851
4,521,321 A 6/1985 Anderson et al. ..... 508/405
4,537,689 A 8/1985 Morrow et al. ..... 508/143
4,595,519 A 6/1986 Takeno et al. ..... 252/79.1
4,604,220 A 8/1986 Stanton ..... 508/179
4,636,321 A 1/1987 Kipp et al. ..... 508/431
4,648,985 A 3/1987 Thorsell et al. ..... 508/364
4,719,022 A 1/1988 Hyde ..... 508/588
4,749,503 A 6/1988 Bennett et al. ..... 508/487
4,752,527 A 6/1988 Sanzero et al. ..... 428/391
4,789,593 A 12/1988 Das ..... 428/391
4,837,019 A 6/1989 Georgalas et al. ..... 424/59
4,869,839 A 9/1989 Griffin et al. ..... 508/502
4,929,375 A 5/1990 Rossio et al. ..... 508/415
4,954,338 A 9/1990 Mattox ..... 514/372
4,995,997 A 2/1991 Noda et al. ..... 508/262
5,002,675 A 3/1991 Randisi ..... 508/219
5,009,801 A 4/1991 Wider et al. ..... 508/390
5,062,978 A 11/1991 Weber et al. ..... 508/500
5,062,979 A 11/1991 Scharf et al. ..... 508/408
5,073,280 A 12/1991 Rossio et al. ..... 508/410
5,091,174 A 2/1992 Lemberger ..... 424/75
5,102,567 A 4/1992 Wolf ..... 508/563
5,141,802 A 8/1992 Parrinello et al. ..... 428/288
5,149,536 A 9/1992 Ratkus ..... 424/401
5,160,646 A 11/1992 Scheld ..... 508/183
5,174,914 A 12/1992 Gutzmann ..... 508/410
5,232,691 A 8/1993 Lemole ..... 424/78.02
5,244,589 A 9/1993 Liu et al. ..... 508/449
5,286,300 A 2/1994 Hnatin et al. ..... 134/2
5,326,492 A 7/1994 Hodam, Jr. ..... 510/383
5,334,322 A 8/1994 Williams, Jr. ..... 508/579
5,352,376 A 10/1994 Gutzmann ..... 508/216
5,364,874 A 11/1994 Morpeth ..... 514/373
5,372,220 A 12/1994 Jacobs et al. ..... 184/6.14
5,391,308 A * 2/1995 Despo ..... 508/164
5,441,654 A * 8/1995 Rossio ..... 508/527
5,462,681 A 10/1995 Gutzmann et al. ..... 508/513
5,470,874 A 11/1995 Lerner ..... 514/474
5,490,983 A 2/1996 Worley et al. ..... 424/405
5,510,045 A * 4/1996 Remus ..... 508/558
5,559,087 A 9/1996 Halsrud et al. ..... 508/579
5,616,679 A 4/1997 Fies et al. ..... 528/76
5,622,708 A 4/1997 Carlson et al. ..... 424/405
5,672,401 A 9/1997 Anglin et al. ..... 428/64.1
5,681,628 A 10/1997 Niederst et al. ..... 428/35.7
5,723,418 A 3/1998 Person Hei et al. ..... 508/511
5,772,003 A 6/1998 Hunt ..... 198/495
5,863,874 A 1/1999 Person Hei et al. ..... 508/521
5,869,436 A 2/1999 Lindman ..... 508/174
5,932,526 A 8/1999 Person Hei et al. ..... 508/559
5,935,914 A 8/1999 Theyssen et al. ..... 508/517
5,985,804 A 11/1999 Ashjian et al. ..... 508/287
6,004,909 A 12/1999 Lindman ..... 508/174
6,090,761 A * 7/2000 Butler et al. ..... 508/486
6,214,777 B1 4/2001 Li et al. ..... 508/388
6,316,394 B1 11/2001 Morgan et al.
6,342,470 B1 1/2002 Aronson et al. ..... 510/153
6,427,826 B1 8/2002 Li et al. ..... 198/500
6,475,961 B2 11/2002 Lokkesmoe et al. ..... 508/149
6,525,005 B1 * 2/2003 Kravitz et al. ..... 508/438

* cited by examiner

BUFFERED LUBRICANT FOR CONVEYOR SYSTEM

FIELD OF THE INVENTION

The invention pertains to food additive lubricant compositions, and more particularly, to a food additive lubricant composition that includes a fatty acid, a neutralization agent, a pH buffer and a carrier. The invention also pertains to a food additive lubricant composition suitable for use on a moving surface. The invention also pertains to a method of lubricating.

BACKGROUND

In many industries, including, for example, the food and beverage processing industry, containers and other articles are transported from one location to another location by conveyors such as belt conveyors. In many such conveyor systems, a lubricating composition may be used on the conveyor. One of the reasons that a lubricating composition may be used is to facilitate movement and reduce the damage to the containers resulting from mechanical impact between the containers and the rubbing action among the containers and between the containers and the belt. For example, occasionally in such systems, the containers are stopped on the conveyor due to a back up on the conveyor. While the containers are stopped, the belt is often still moved continuously. To facilitate the smooth transportation of the containers, a lubricating composition can be applied onto the surface of the conveyor belt and/or the containers.

There can be numerous challenges in providing a lubricant composition for use on conveyors. One example of a potential challenge deals with the desire for a lubricant with decreased pH sensitivity. Fatty acid based lubricants typically display decreased lubricity at low pH. This phenomenon is especially a problem in the beverage processing industry. For example, many beverages, including colas, lemonades and iced teas, have a low pH as a result of being acidic. Those commercial beverages having a pH slightly above 3 include Coca-Cola®, Pepsi Cola®, Orange Slice®, Mountain Dew®, Sprite®, and Mellow Yellow®. Some are even more acidic with a pH below 3 such as Minute Maid Lemonade®, Minute Maid Orange Soda®, Fruit Work Pink Lemonade® and Brisk Lemon Iced Tea®. When acidic beverages are moved along a conveyor, they can spill and come into contact with the lubricant on the conveyor and lower the pH of the lubricant. This decrease in pH may decrease the lubricity of the lubricant. Thus it is desirable that a lubricant have decreased pH sensitivity especially in the presence of acidic beverages.

Additionally, there is a desire for conveyor lubricants in the food and beverage industry to be composed of food additives. Many compositions that come into contact with food or beverages are required to be composed entirely of food additives. It is desirable that conveyor lubricants that can potentially come into contact with food and beverages for human consumption be composed of food additives.

There is an ongoing need to provide food additive lubricant compositions and methods for lubricating conveyor systems which have decreased pH sensitivity, especially in the acidic region.

SUMMARY

The invention pertains to food additive lubricant compositions, and more particularly, to a food additive lubricant composition that includes a fatty acid, a neutralization agent, a pH buffer and a carrier. The invention also pertains to a food additive lubricant composition suitable for use on a moving surface. Finally, the invention pertains to a method of lubricating.

These and other embodiments will be apparent to those of skill in the art and others in view of the following detailed description. It should be understood, however, that this summary, and the detailed description illustrate only some examples, and are not intended to be limiting to the invention as claimed.

DETAILED DESCRIPTION OF THE INVENTION

Definitions

For the following defined terms, these definitions shall be applied, unless a different definition is given in the claims or elsewhere in this specification.

All numeric values are herein assumed to be modified by the term "about," whether or not explicitly indicated. The term "about" generally refers to a range of numbers that one of skill in the art would consider equivalent to the recited value (i.e., having the same function or result). In many instances, the term "about" may include numbers that are rounded to the nearest significant figure.

Weight percent, percent by weight, % by weight, wt %, and the like are synonyms that refer to the concentration of a substance as the weight of that substance divided by the weight of the composition and multiplied by 100.

The recitation of numerical ranges by endpoints includes all numbers subsumed within that range (e.g. 1 to 5 includes 1, 1.5, 2, 2.75, 3, 3.80, 4 and 5).

As used in this specification and the appended claims, the singular forms "a", "an", and "the" include plural referents unless the content clearly dictates otherwise. Thus, for example, reference to a composition containing "a compound" includes a mixture of two or more compounds. As used in this specification and the appended claims, the term "or" is generally employed in its sense including "and/or" unless the content clearly dictates otherwise.

The term "alkyl" refers to a straight or branched chain monovalent hydrocarbon radical having a specified number or carbon atoms. Alkyl groups may be unsubstituted or substituted with substituents that do not interfere with the specified function of the composition and may be substituted once or twice with the same or different group. Substituents may include alkoxy, hydroxy, mercapto, amino, alkyl substituted amino, nitro, carboxy, carbonyl, carbonyloxy, cyano, methylsulfonylamino, or halo, for example. Examples of "alkyl" include, but are not limited to, methyl, ethyl, n-propyl, isopropyl, n-butyl, s-butyl, t-butyl, n-pentyl, n-hexyl, 3-methylpentyl, and the like.

The term "alkenyl" or "alkenylene" refers to a straight or branched chain divalent hydrocarbon radical having a specified number of carbon atoms and one or more carbon-carbon double bonds. Alkenylene groups may be unsubstituted or substituted with substituents that do not interfere with the specified function of the composition and may be substituted once or twice with the same or different group. Substituents may include alkoxy, hydroxyl, mercapto, amino, alkyl substituted amino, nitro, carboxy, carbonyl, carbonyloxy, cyano, methylsulfonylamino, or halo, for example. Examples of "alkenyl" or "alkenylene" include, but are not limited to, ethene-1,2-diyl, propene-1,3-diyl, and the like.

Compositions

As discussed above, the invention generally relates to a lubricant composition, and a method of lubricating a moving surface using such a lubricant. The lubricant comprises a fatty acid, a neutralization agent, a pH buffer and a carrier. The lubricant can be a concentrate that can be used alone, or can be mixed with additional carrier, such as water, to form a dilute lubricant mixture. In addition, the composition can optionally include additional active or functional ingredients or components that enhance the effectiveness of the composition as a lubricant, or enhance or provide other functional aspects to the composition.

Decreasing the pH of a fatty acid based lubricant results in decreased lubricity on the moving surface. The main ingredient providing lubricity for a metal surface is the carboxylate ions dissociated from the fatty acid. In a basic environment, there are more carboxylate ions present in the dilute lubricant solution whereas in the acidic region when beverage spillage may be mixed with the lubricant, carboxylate ions, will decrease in a logrithmic scale with lower pH. It has been discovered that including a pH buffer decreases the lubricant's sensitivity to decreases in pH. As such, formulations can be produced that include fatty acids that maintain lubricity under low pH conditions. This provides for a conveyor lubricant that may be effective as a lubricant in low pH conditions.

The composition as a concentrate can either be a liquid or a solid depending on the choice and concentrations of raw materials. Although lubricants can be manufactured and sold in dilute form, they are often sold as concentrates because of the ease of handling and shipping cost. A lubricant concentrate may be substantially solid, having less than 1 wt-% of a carrier fluid for carrying the various ingredients of the lubricant.

The lubricant concentrate may be diluted with additional carrier in a concentrate/carrier ratio of 1:50 to 1:1000 before using. In another aspect, a method of lubricating a continuously-moving conveyor system for transporting a container may be practiced by applying diluted aqueous lubricating composition to the surface of the plastic conveyor. This application may be by means of spraying, immersing, brushing and the like. The dilution may be done either batchwise by adding water into a container with a suitable amount of the concentrate or continuously online. Online dilution may be done by the regulated injection of a stream of concentrate into a stream of water at a steady rate. The injection of the concentrate can be achieved by a pump, for example, a metering pump, although other injection means are possible. Water of varying quality, for example, tap water, soft water, and deionized water may be used. The water may also be heated.

The compositions may be applied in relatively low amounts, and do not require dilution with significant amounts of a carrier. In this case, the composition provides a thin, substantially non-dripping lubricating film. In contrast to dilute compositions, such compositions can provide drier lubrication of the conveyors, and/or containers, a cleaner and drier conveyor line and working area, and reduced lubrication usage, thereby reducing waste, cleanup, and disposal problems.

It may be desirable to provide one or more of the various components of the composition in separate containers until it is desired to make the final composition. For example, the neutralization component, the fatty acid component, the carrier component, and the pH buffer component can be provided in separate containers until it is desired to make the composition. By maintaining such components in separate containers until it is desired to combine them to make the lubricant composition containing both, the components are potentially available for use in other systems. The mixing of the components can be made in concentrates or mixed after dilution. The mixing of the dilution can be made at the point of application or at the mechanical system before transporting the product to the intended use sites.

The lubricant composition, either concentrated or diluted, and in a solid, paste or liquid form can be applied to a conveyor system surface that comes into contact with containers, the container surface that needs lubricity, or both. Any suitable method of applying the lubricant to the conveyor surface and/or the container surface can be used. Some examples of application methods include spraying, wiping, rolling, brushing, atomizing, dipping, and the like, or a combination of any of these. The lubricant composition can be applied to the surface by continuous, intermittent, or one time application. In some situations, only portions of the conveyor that contact the containers need to be treated. Likewise, in some situations, only portions of the container that contact the conveyor or other containers need to be treated. The lubricant can be formulated as a permanent composition that remains on the container or conveyor throughout its useful life, or can be a semi-permanent, or temporary composition.

The surface of the conveyor that supports the containers can be made of a wide variety of materials, for example, fabric, metal, plastic, elastomer, composites, or combinations or mixtures of these materials. Any type of conveyor system used in the container field can be treated according to some examples of the invention. Some examples of conveyors, containers, methods of application, and the like are disclosed in International Patent Application publication number WO 01/12759, the entire disclosure of which is incorporated herein by reference for all purposes.

The lubricant composition can also be formulated to include additional desirable characteristics. For example, it may be desirable to provide a lubricating composition that has biodegradability and nontoxicity. The public is increasingly aware of the ecological problems caused by the release of man-made chemicals in the environment. More stringent governmental regulations are being implemented to respond to this public concern. Therefore, the lubricating composition would desirably contain chemicals that are more biodegradable and less toxic than conventional chemicals used in lubricant concentrates. It may also be desirable that the lubricating composition be compatible with inks or dyes that are used on the surface of the containers. For example, it may be desirable that the lubricant composition be compatible with inks used for date code on some containers, and does not remove such ink from the containers. Finally, in yet another embodiment, the lubricating composition would desirably contain only chemicals that are considered food additives. For example, in the food and beverage industry it may be desirable to use lubricants with ingredients that are suitable for human consumption.

Fatty Acid

The term "fatty acid" includes any of a group of carboxylic acids that can be derived from or contained in an animal or vegetable fat or oil. Fatty acids are composed of a long chain of alkyl groups and characterized by a terminal carboxyl group. The alkyl groups can be linear or branched. The fatty acid can be saturated or unsaturated. The chain of alkyl groups contain from 4 to 24 carbon atoms, 6 to 24 carbon atoms, or 12 to 18 carbon atoms. The lubricant composition can include combinations or mixtures of different fatty acids. One particular fatty acid that may be suitable is oleic acid, but as set forth above, a broad variety of other fatty acids or combinations or mixtures thereof are contemplated for use.

The fatty acid component can comprise up to 99 wt.-% of the final lubricant composition. For example, the concentrate lubricant composition can comprise, in the range of 0.5–99 wt.-% fatty acid component of the fatty acid, neutralization agent, pH buffer and carrier total weight, in the range of 1–50 wt.-% fatty acid component of the fatty acid, neutralization agent, pH buffer and carrier total weight, or in the range of 3–25 wt.-% fatty acid component of the fatty acid, neutralization agent, pH buffer and carrier total weight. Some examples of dilute lubricant compositions can comprise, in the range of 0.003–0.5 wt.-% fatty acid component of the fatty acid, neutralization agent, pH buffer and carrier total weight, in the range of 0.005–0.3 wt.-% fatty acid component of the fatty acid, neutralization agent, pH buffer and carrier total weight, or in the range of 0.015–0.1 wt.-% fatty acid component of the fatty acid, neutralization agent, pH buffer and carrier total weight.

Neutralization Agents

The lubricating composition can also include a neutralization agent for various purposes. One purpose can be to neutralize a portion of the fatty acid component. Additionally, many surfactants are most effective in the neutral pH range. Moreover, acid conditions might lead to chemical attack on certain thermoplastics and metal parts. Therefore, a portion of the fatty acid component, or the available acid from the surfactants employed, e.g. the phosphates, may be neutralized. However, as discussed above, it may be desirable to provide a composition with a relatively low level of alkalinity, for example, in compositions for use with certain thermoplastic containers or conveyors, such as PET containers. Therefore, relatively low levels of alkali neutralizing agent may be used. For example, the level of the total alkalinity at diluted or use concentration may be 100 ppm or less, and in some cases, 50 ppm or less. The alkalinity can be calculated as percent $CaCO_3$. A diluted use solution can have total alkalinity levels in these ranges, while the concentrated composition prior to dilution can have higher levels of alkalinity.

Some commonly used neutralizing agents are the alkaline metal hydroxides such as potassium hydroxide and sodium hydroxide. Another class of neutralizing agent may be the alkyl amines, which may be primary, secondary, or tertiary, such as urea, or cyclic amines such as morpholine.

The neutralization component can comprise up to 30 wt.-% of the final lubricant composition. For example, the lubricant concentrate composition can comprise, in the range of 1–29 wt.-% neutralization component of the fatty acid, neutralization agent, pH buffer and carrier total weight, in the range of 2–20 wt.-% neutralization component of the fatty acid, neutralization agent, pH buffer and carrier total weight, or in the range of 3–10 wt.-% neutralization component of the fatty acid, neutralization agent, pH buffer and carrier total weight. Some examples of dilute or use lubricant compositions can comprise, in the range of 0.005–0.2 wt.-% neutralization component of the fatty acid, neutralization agent, pH buffer and carrier total weight, in the range of 0.01–0.1 wt.-% neutralization component of the fatty acid, neutralization agent, pH buffer and carrier total weight, or in the range of 0.015–0.05 wt.-% neutralization component of the fatty acid, neutralization agent, pH buffer and carrier total weight.

pH Buffer

The term "pH buffer" includes any composition that stabilizes pH and derivatives, mixtures or combinations thereof. For example, a pH buffer can include the following groups: phosphates, carbonates, amines, bicarbonates, and citrate. One particular pH buffer that may be suitable is carbonate but as set forth above, other pH buffers may be used. The term "phosphate" includes, for example, the following: anhydrous nono, di or tri-sodium phosphate, sodium tripolyphosphate, tetra-sodium pyrophosphate and tetra-potassium pyrophosphate. The term "carbonate" includes, for example, the following: sodium carbonate, potassium carbonate and sesquicarbonate. The term "bicarbonate" includes, for example, the following: sodium bicarbonate and potassium bicarbonate. The term "citrate" includes, for example, the following: sodium citrate and potassium citrate. The term "amines" includes, for example, the following: urea and morpholine.

The pH buffer component can comprise up to 20 wt.-% of the final lubricant composition. For example, the lubricant concentrate composition can comprise, in the range of 0.1–20 wt.-% pH buffer component of the fatty acid, neutralization agent, pH buffer and carrier total weight, in the range of 0.5–10 wt.-% pH buffer component of the fatty acid, neutralization agent, pH buffer and carrier total weight, or in the range of 1–5 wt.-% pH buffer component of the fatty acid, neutralization agent, pH buffer and carrier total weight. Some examples of dilute lubricant compositions can comprise, in the range of 0.001–0.1 wt.-% pH buffer component of the fatty acid, neutralization agent, pH buffer and carrier total weight, in the range of 0.003–0.1 wt.-% pH buffer component of the fatty acid, neutralization agent, pH buffer and carrier total weight, or in the range of 0.005 to 0.025 wt.-% pH buffer component of the fatty acid, neutralization agent, pH buffer and carrier total weight.

Carrier

It may be preferable that the lubricant concentrate have a carrier fluid. The carrier may be present in both the concentrate and dilute formulas. Water is the most commonly used and preferred carrier for carrying the various ingredients in the formulation of the lubricant concentrate. It is possible, however, to use a water-soluble solvent, such as alcohols and polyols. These solvents may be used alone or with water. Some examples of suitable alcohols include methanol, ethanol, propanol, butanol, and the like, as well as mixtures thereof. Some examples of polyols include glycerol, ethylene glycol, propylene glycol, diethylene glycol, and the like, as well as mixtures thereof.

The carrier component can comprise up to 99 wt.-%. of the final lubricant composition. For example, the lubricant concentrate composition can comprise, in the range of 0–80 wt.-% carrier component of the fatty acid, neutralization agent, pH buffer and carrier total weight, in the range of 5–80 wt.-% carrier component of the fatty acid, neutralization agent, pH buffer and carrier total weight, or in the range of 20–60 wt.-% carrier component of the fatty acid, neutralization agent, pH buffer and carrier total weight. Some examples of dilute lubricant compositions can comprise in the range of 0–99 wt.-% carrier component of the fatty acid, neutralization agent, pH buffer and carrier total weight, in the range of 0.5–99 wt.-% carrier component of the fatty acid, neutralization agent, pH buffer and carrier total weight, or in the range of 1–99 wt.-% carrier component of the fatty acid, neutralization agent, pH buffer and carrier total weight.

Food Additive

The term "food additive" means that a composition or chemical may be suitable for human consumption. In the food and beverage industry, it may be desirable that any composition or chemical that comes into contact with foods and beverages for human consumption, including conveyor lubricants, be suitable for human consumption. Thus, every chemical that makes up a composition would have to be suitable for human consumption.

There is an information data base maintained by the U.S. Food and Drug Administration Center for Food Safety and Applied Nutrition which list materials as safe for food additives under the REGNUM (Regulation numbers in Title 21 of the U.S. Code of Federal Regulations). Under the Title 21 regulation, any materials with part 172 (food additives permitted for direct addition to food for human consumption), part 178 (indirect food additive), part 182 (substances generally recognized as safe) and part 184 (direct food substances affirmed as generally recognized as safe) classifications are considered as food additives. For purposes of this application, "food additive" means any material found in part 172, 178, 182, or 184 of title 21 of the Code of Federal Regulations as of Apr. 1, 2002.

Examples of fatty acids that are suitable food additives include the following: oleic acid, tall oil fatty acid, and refined coconut oil.

Examples of neutralization agents that are suitable food additives include the following: sodium and potassium hydroxide, morpholine and urea Examples of pH buffers that are suitable food additives include the following: sodium and potassium bicarbonates, sodium and potassium carbonates, sodium sesquicarbonate, sodium and potassium citrates, monobasic, dibasic and tribasic sodium phosphates, sodium pyrophosphate, sodium tri-polyphosphate, and sodium metaphosphate.

Examples of carriers that are suitable food additives include the following: benzyl alcohol, benzyl acetate, ethyl acetate, propylene glycol, and water.

Examples of chelating agents that are a suitable food additives include the following: disodium EDTA and calcium disodium EDTA.

Examples of polyalkylene glycol polymers that are suitable food additives include the following: Carbowax™ and Ucon™ products available from Union Carbide, or block and random copolymers of ethylene oxide and propylene oxide, and derivatives of mixtures of any of these. One example of a trade name for such block copolymers is Pluronics® and is manufactured by BASF.

Other Functional Ingredients

Other active ingredients may optionally be used to improve the effectiveness of the lubricant. Some non-limiting examples of such additional active ingredients can include the following: surfactants, polyalkylene glycol polymers, stabilizing/coupling agents, antimicrobial agents, viscosity modifiers, sequestrants/chelating agents, bleaching agents such as hydrogen peroxide and others, dyes, odorants, and the like, and other ingredients useful in imparting a desired characteristic or functionality in the lubricant composition. The following describes some examples of such ingredients.

Polyalkylene Glycol Polymer

The term "polyalkylene glycol polymer" includes polymers of alkylene oxides or derivatives and mixtures or combinations thereof. For example, polyalkylene glycol polymers can include polymers of the following general formula, and derivatives thereof:

$$H—O—(RO)_x—H$$

wherein R is a linear or branched alkyl, and x is a positive integer, and may be in the range of 4 to 500 for low molecular weight polyalkylene glycol polymers, and in some cases up to about hundreds of thousand for high molecular weight polyalkylene glycol polymers. Some examples of commercially available lower molecular weight polyalkylene glycol polymers include Carbowax™ and Ucon™ products available from Union Carbide, and some examples of commercially available higher molecular weight polyalkylene glycol products include POLYOX™ products available from Union Carbide.

As is apparent from above, the term "polyalkylene glycol polymer" also can include derivatives of such polyalkylene glycol polymers. Some examples of such derivatives can include polyalkylene glycol polymers modified by substitution on one or more of the terminal hydroxyl groups. For example, one or more of the terminal hydroxyl groups can be substituted with alkyl or acyl groups to form an ether, or a carbonyl group to form an ester. Some examples of such derivatives include compounds of the following formulas:

$$R'—O—(RO)_x—H \quad R'—COO—(RO)_x—H$$

wherein R' is linear or branched alkyl or aryl, and in some cases may be in the range of $C_1$–$C_{26}$ alkyl or aryl, in the range of $C_{12}$–$C_{18}$ alkyl or aryl, or in the range of $C_{12}$–$C_{18}$ alkyl or aryl.

The polyalkylene glycol polymer component can be in the form of a homopolymer, or mixtures or combinations of homopolymers, or can include copolymers, such as block or random copolymers, or mixtures of combinations of such copolymers, or can include mixtures or combinations of homopolymers and copolymers. In some examples, the polyalkylene glycol polymers range in molecular weight from 200 to several million, from 200 to 100,000, from 200 to 20,000, and from 200 to 10,000. The polyalkylene glycol polymer components can be in liquid, paste or solid form.

The polyalkylene glycol polymer may include homopolymers of polyethylene glycols, polypropylene glycols, or block and random copolymers of ethylene oxide and propylene oxide, and derivatives of mixtures of any of these. For example, block copolymers of ethylene oxide and propylene oxide are known in the art as nonionic surfactants and are commercially available. One example of a trade name for such block copolymers is Pluronics® and is manufactured by BASF.

One particular type of polyalkylene glycol polymer used includes ethylene oxide/propylene oxide copolymer wherein the polymer may be prepared by the controlled addition of propylene oxide to the two hydroxyl groups of propylene glycol. Ethylene oxide may then be added to sandwich this hydrophobe between hydrophilic groups, controlled by length to constitute from 10% to 80% (by weight) of the final molecule.

This type of polymer is best illustrated by the following formula:

$$HO—(CH_2CH_2O)_x—(CH_2\overset{\overset{CH_3}{|}}{C}HO)_y—(CH_2CH_2O)_{x'}—H$$

The x, y, and x' in the formula have no definite integers, but depend on the amount of ethylene oxide and propylene oxide in the desired polymer. In this particular embodiment, ethylene oxide constitutes anywhere from 10 to 80 wt.-%.

A second type of block copolymer may be that prepared by adding ethylene oxide to ethylene glycol to provide a hydrophile of designated molecular weight. Propylene oxide may then added to obtain hydrophobic blocks on the outside of the molecule thereby creating another sandwich. The structure of this polymer is illustrated as follows:

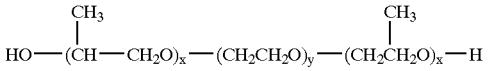

The content of ethylene oxide can range from 10 to 80 wt.-%.

The block copolymers may be those between the molecular weight range of 800 to 40,000 and comprise polypropylene oxide sandwiched by polyethylene oxide blocks wherein the ethylene oxide constitutes from 10 to 80 wt.-% of a copolymer. One particular example of a useful block copolymer is that polymer identified as Pluronic® F-108, which has an average molecular weight of 14,600, a melt-pour point of 57° C., is a solid at room temperature with a viscosity of 2,800 cps at 77° C. and a surface tension in dynes/cm of 41 at 25° C., @ 0.1%.

The polyalkylene glycol component can comprise a very broad range of weight percent of the entire composition, depending upon the desired properties. For example, for concentrated embodiments, the polyalkylene glycol polymer can comprise in the range of 0 to 50 wt.-% of the total composition, in the range of 0 to 35 wt.-% of the total composition, or in the range of 0 to 25 wt.-% of the total composition. For some diluted or use concentration, the polyalkylene glycol polymer can comprise in the range of 0 to 0.1 wt.-% of the total composition, in the range of 0 to 0.07 wt.-% of the total composition, or in the range of 0 to 0.05 wt.-% of the total composition.

Surfactants

The lubricant concentrate may also contain cationic, anionic, amphoteric, and nonionic surfactants, or mixtures thereof. For a discussion on surfactants, see Kirk-Othmer, Surfactants in Encyclopedia of Chemical Technology, 19:507–593 (2d ed. 1969), which is incorporated by reference herein.

Some examples of anionic surfactants suitable for use include carboxylates, sulfates, sulfonates, such as sodium lauryl sulfate, sulfosuccinates, and mixtures thereof. Some embodiments include alkaline salts of $C_8$–$C_{10}$ saturated and unsaturated fatty acids, such as, for example, tall oil, oleic acid, or coconut oil. One particular example includes a sodium tall oil soap. When used in the lubricant composition, the anionic surfactant may be present in a range of up to 50 wt-%.

Some examples of cationic surfactants suitable for use include quaternary ammonium surfactants with one or two long chain fatty alkyl groups and one or two lower alkyl or hydroxyalkyl substituents. Preferable examples are alkylbenzyl dimethyl ammonium chloride wherein the alkyl groups are a stearyl, tallow, lauryl, myristyl moiety, and the like, and mixtures thereof. When used in the lubricant composition, in some embodiments the cationic surfactants can be present in a range of up to 50 wt-%.

Some examples of nonionic surfactants include polyalkylene oxide condensates of long chain alcohols such as alkyl phenols and aliphatic fatty alcohols. Some specific examples contain alkyl chains of $C_6$–$C_{18}$. Typical examples are polyoxyethylene adducts of tall oil, coconut oil, lauric, stearic, oleic acid, and the like, and mixtures thereof. Other nonionic surfactants can be polyoxyalkylene condensates of fatty acids having from 8 to 22 carbon atoms in the fatty alkyl or acyl groups and 10 to 40 alkyloxy units in the oxyalkylene portion. An exemplary product is the condensation product of coconut oil with 10 to 30 moles of ethylene oxide. It is possible to form a block copolymer by condensing different alkylene oxides with the same fatty acid. An example is a polyoxyalkylene condensate of a long chain fatty acid with three blocks of oxyalkylene units wherein the first and third block consists of propylene oxide moiety and the second block consists of ethylene oxide moiety. The block copolymer may be linear or branched.

Yet another kind of nonionics are alkoxylated fatty alcohols. Typical products are the condensation products of n-decyl, n-dodecyl, n-octadecyl alcohols, and a mixture thereof with 3 to 50 moles of ethylene oxide.

Another kind of nonionics are alkylene oxide adducts of relatively low degree of polymerization alkylglycosides. These oxyalkylated glycosides comprise a fatty ether derivative of a mono-, di-, tri-, etc. saccharide having an alkylene oxide residue. Preferable examples contain 1 to 30 units of an alkylene oxide, typically ethylene oxide, 1 to 3 units of a pentose or hexose, and an alkyl group of a fatty group of 6 to 20 carbon atoms. An oxyalkylated glycoside compares with the general formula of:

$$H\text{-}(AO)m\text{-}G_y\text{-}O\text{—}R$$

where AO is an alkylene oxide residue; m is the degree of alkyl oxide substitution having an average of from 1 to 30, G is a moiety derived from a reducing saccharide containing 5 of 6 carbon atoms, i.e. pentose or hexose; R is a saturated or nonsaturated fatty alkyl group containing 6 to 20 carbon atoms; and y, the degree of polymerization (D.P.) of the polyglycoside, represents the number of monosaccharide repeating units in the polyglycoside, and is an integer on the basis of individual molecules, but may be a noninteger when taken on an average basis when used as an ingredient for lubricants.

Some specific examples include sorbitan fatty acid esters, such as the Spans® and the polyoxyethylene derivatives of sorbitan and fatty acid esters known as the Tweens®. These are the polyoxyethylene sorbitan and fatty acid esters prepared from sorbitan and fatty esters by addition of ethylene oxide. Some specific examples of these are polysorbate 20, or polyoxyethylene 20 sorbitan monolaurate, polysorbate 40, or polyoxyethylene 20 sorbitan monopalmatate, polysorbate 60, or polyoxyethylene 20 sorbitan monostearate, or polysorbate 85, or polyoxyethylene 20 sorbitan triolyate. Used in the lubricant composition, in some embodiments the nonionic surfactant can be present in a range of up to 50 wt-%.

Alternatively, the lubricant can include a nonionic surfactant that may be an alkylpolyglycoside. Alkylpolyglycosides (APGs) also contain a carbohydrate hydrophile with multiple hydroxyl groups.

APGs are fatty ether derivatives of saccharides or polysaccharides. The saccharide or polysaccharide groups are mono-, di-, tri-, etc. saccharides of hexose or pentose, and the alkyl group may be a fatty group with 7 to 20 carbon atoms. Alkylpolyglycosides can be compared with the general formula of:

$$G_x\text{-}O\text{—}R$$

where G is a moiety derived from a reducing saccharide containing 5 or 6 carbon atoms, i.e. pentose or hexose; and R is a saturated or nonsaturated fatty alkyl group containing 6 to 20 carbon atoms; x, the degree of polymerization (D.P.) of the polyglycoside, representing the number of monosaccharide repeating units in the polyglycoside, is an integer on the basis of individual molecules, but may be a noninteger when taken on an average basis when used as an ingredient for lubricants. In some embodiments, x has the value of less than 2.5, or in the range or 1 and 2. The reducing saccharide moiety, G can be derived from pentose or hexose. Exemplary saccharides are glucose, fructose, mannose, galactose, talose, gulose, allose, altrose, idose, arabinose, xylose, lyxose and ribose. Because of the ready availability of glucose, glucose is a common embodiment in the making of polyglycosides.

The fatty alkyl group may be a saturated alkyl group, although unsaturated alkyl fatty group can be used. It may also be possible to use an aromatic group such as alkylphenyl, alkylbenzyl and the like in place of the fatty alkyl group to make an aromatic polyglycoside.

Generally, commercially available polyglycosides have alkyl chains of $C_8$–$C_{16}$ and an average degree of polymerization in the range of 1.4 to 1.6. A lubricant composition of the invention may include up to 50 wt-%, or in the range of 3 wt-% to 10 wt-% of alkylpolyglycoside.

Stabilizing/Coupling Agents

In a lubricant concentrate, stabilizing agents, or coupling agents can be employed to keep the concentrate homogeneous, for example, under cold temperature. Some of the ingredients may have the tendency to phase separate or form layers due to the high concentration. Many different types of compounds can be used as stabilizers. Examples are ethanol, urea, glycols such as propylene glycol, mono- and dimethyl sodium naphthaline sulfonates and the like. The stabilizing/coupling agents can be used in an amount to give the desired results. This amount can range, for example, from about 0 to 30 wt.-% of the total composition.

Antimicrobial Agents

Antimicrobial agents can also be added. Some useful antimicrobial agents include disinfectants, antiseptics, and preservatives. Some non-limiting examples include organic and inorganic acids and its esters and salts such as dehydroacetic acid, peroxycarboxylic acids, peroxyacetic acid, methyl p-hydroxy benzoic acid, cationic agents such as quaternary ammonium compound, and potassium iodide. The antimicrobial agents can be used in amounts to provide the desired antimicrobial properties. In some examples, the amount can range from 0 to 20 wt.-% of the total composition.

Viscosity Modifiers

Viscosity modifiers can also be used. Some examples of viscosity modifiers include pour-point depressants and viscosity improvers, such as polyacrylamides, polyvinyl alcohols, polyacrylic acids, and high molecular weight polyoxyethylenes. The modifiers can be used in amounts to provide the desired results. The viscosity modifiers can range from 0 to 30 wt.-% of the total composition.

Sequestrants

In addition to the aforementioned ingredients, it may be possible to include other chemicals in the lubricant. For example, where soft water is unavailable and hard water is used for the dilution of the lubricant concentrate, there may be a tendency for the hardness cations, such as calcium, magnesium, and ferrous ions, to reduce the efficacy of the surfactants, and even form precipitates when coming into contact with ions such as sulfates, and carbonates. Sequestrants can be used to form complexes with the hardness ions. A sequestrant molecule may contain two or more donor atoms which are capable of forming coordinate bonds with a hardness ion. Sequestrants that possess three, four, or more donor atoms are called tridentate, tetradentate, or polydentate coordinators. Generally the compounds with the larger number of donor atoms are better sequestrants. The preferable sequestrant is ethylene diamine tetracetic acid (EDTA), such as $Na_2EDTA$ and calcium disodium EDTA sold by Dow Chemicals. Some additional examples of other sequestrants include: iminodisuccinic acid sodium salt, trans-1,2-diaminocyclohexane tetracetic acid monohydrate, diethylene triamine pentacetic acid, sodium salt of nitrilotriacetic acid, pentasodium salt of N-hydroxyethylene diamine triacetic acid, trisodium salt of N,N-di(beta-hydroxyethyl) glycine, sodium salt of sodium glucoheptonate, and the like.

For a more complete understanding of the invention, the following examples are given to illustrate some embodiments. These examples and experiments are to be understood as illustrative and not limiting. All parts are by weight, except where it is contrarily indicated.

EXAMPLES

The following chart provides a brief explanation of certain chemical components used in the following examples:

TABLE 1

Trade names and corresponding description of some chemicals used in the examples.

| Trademark/Chemical Name | Description | Commercially available from: |
|---|---|---|
| KX5139 | Food additive fatty acid lubricant | Ecolab |
| KG20 | Non-food additive fatty acid lubricant | Ecolab |
| Potassium carbonate | Food additive | |

Additionally, in some of the following examples, the lubricity of some of the lubricants was determined using the following testing methods:

Slider Lubricity Test

In the slider tests, the lubricity of testing samples was done by measuring the drag force (frictional force) of a 50 gram weighted cylinder riding on a rotating disc, wetted by the testing sample. The material for the cylinder may be chosen to coincide with the container materials, e.g., glass, PET, or mild steel. Similarly the material of the rotating disc is the same as the conveyor, e.g., stainless steel or plastic. The drag force, using an average value, is measured with a solid state transducer, which is connected to the cylinder by a thin flexible string. The weight of the cylinder made from the same material is consistent for all measurements. Complete lubricity (i.e, no weight) has a drag force of 0 grams. No lubricity (i.e. no lubricant) has a drag force of 50 grams. As lubricity increases, the drag force decreases from 50 grams.

pH Measurement Test

A standard pH meter with glass electrode was used. Calibration is performed on a daily basis with standard buffers of pH 4 and pH 10.

Example 1

Lubricity Maintained with a Composition that Contains Carbonate as a pH Buffer.

This example demonstrates that lubricity decreases at a pH below 5. Also, this example shows that adding a pH buffer, in this case carbonate, helps maintain the pH above 5 in the presence of acidic beverages.

The following table shows three compositions that were prepared by admixing the listed ingredients in the appropriate wt.-% as shown. Formula A is a food additive fatty acid lubricant but does not include a pH buffer. Formula B is a non-food additive fatty acid lubricant and does not have a pH buffer. Formula C includes a food additive fatty acid plus carbonate as a pH buffer.

TABLE 2

Formulas A, B and C

| Component | Formula A (wt.-% in formula) | Formula B (wt.-% in formula) | Formula C (wt.-% in formula) |
|---|---|---|---|
| KX5139 | 100% | 0% | 95% |
| KG20 | 0% | 100% | 0% |
| $K_2CO_3$ | 0% | 0% | 5% |

Each of these formulas was diluted with de-ionized water to a 2% solution and then mixed with either lemonade, pink lemonade or Lipton™ iced tea in a ratio of 70% diluted lubricant solution to 30% beverage. The pH of the mixture was then measured and the results are shown in the following table.

TABLE 3 pH of formulas A, B and C when mixed with lemonade, pink lemonade and Lipton ™ iced tea

| 2% lube/beverage 70:30 ratio | pH (lemonade) | pH (pink lemonade) | pH (Lipton ™ iced tea) |
|---|---|---|---|
| Formula A | 4.2 | 4.2 | 6.6 |
| Formula B | 5.2 | 5.1 | 8.0 |
| Formula C | 5.5 | 5.5 | 8.0 |

The following table shows the pH of Formulas A, B and C when diluted with de-ionized water to a 2% lubricant solution without an acidic beverage.

TABLE 4 pH of formulas A, B and C

| 2.0% lubricant concentration | pH |
|---|---|
| Formula A | 10.4 |
| Formula B | 10.8 |
| Formula C | 10.8 |

The following table shows the drag force for formulas A, B and C when diluted with de-ionized water to a 2% lubricant solution and mixed in a 70:30 ratio with lemonade. A 0.5% lubricant solution in de-ionized water commercially known as Lubodrive rx™ from Ecolab was tested as a control. The results are listed below.

TABLE 5

The COF of formulas A, B and C when mixed with lemonade

| Formula | pH | Drag force (g) |
|---|---|---|
| 0.5% L-rx (no lemonade) | | 32 |
| Formula A | 4.2 | More than 50 |
| Formula B | 5.2 | 34.5 |
| Formula C | 5.5 | 32.5 |

In the slider test, a low drag force indicates better lubricity. Table 5 shows that at a pH below 5, lubricity decreases. The drag force of the control is 32. Formulas B and C had a pH above 5 and displayed an adequate level of lubricity with a drag force of 34.5 and 32.5 respectively. Formula C is preferable to Formula B because it is composed of food additive ingredients. Using a formula with food additives is useful in the food and beverage industry where the lubricant may come into contact with substances meant for human consumption. Formula A, which is Formula C without the carbonate, clearly displayed poor lubricity at a pH of 4.2. Thus, it is clear that the presence of a pH buffer, in this case carbonate, is responsible for maintaining lubricity in the presence of an acidic beverage.

Table 5 shows that lubricity is at an adequate level if the pH remains above 5. Table 3 shows that Formula C displayed a pH above 5 when mixed with lemonade, pink lemonade and Lipton™ iced tea. It follows then that Formula C would display an adequate level of lubricity when mixed with any of these three beverages. Formula B displayed an adequate pH but again, is not composed of all food additives. Formula A, which is the same as Formula C but without the carbonate, did not display an adequate pH except for the Lipton™ iced tea. Again, this shows that it is the addition of the carbonate that helps maintain lubricity when the lubricant solution comes in contact with an acidic beverage.

Example 2 pH and Cold Water Solubility of Food Additive

TABLE 6 pH and cold water solubility of food additives

| Material | Formula | 1% pH | Solubility, in grams per 100 cc cold water from CRC handbook |
|---|---|---|---|
| Caustic Soda | NaOH | 12.4 | 42 |
| Caustic Potash | KOH | 12.5 | 107 |
| Dense Ash | $Na_2CO_3$ | 11.1 | 7 |
| Bicarbonate | $NaHCO_3$ | 8.1 | 7 |
| Sesquicarbonate | $Na_2CO_3.NaHCO_3.2H_2O$ | 9.9 | |
| Potassium Carbonate | $K_2CO_3$ | 11.2 | 112 |
| Anhydrous TSP | $Na_3PO_4$ | 11.8 | 9 |
| Anhydrous DSP | $Na_2HPO_4$ | 9.1 | |
| Tripoly | $Na_5P_3O_{10}$ | 9.7 | Around 10 |
| Pyrophosphate | $Na_4P_2O_7$ | 10 | 3.2 |
| Urea | $NH_2CONH_2$ | Around 8 | High |
| Morpholine | | Around 8 | High |

The pH of a commercial lubricant at the dilute concentration may not exceed 11. Lubricants with high pH are corrosive to metal, plastic or glass surfaces. As such, only the controlled amount of caustic soda was added to the fatty acid lubricant. Any excess amount of caustic will cause the lubricant solution to have a pH higher than 11. Table 6 lists the commonly used food additives with buffering capability. Several phosphates in the table have appropriate buffer capacity with 1% pH value from 9–11. However, the solubility of these phosphates are low in cold water and the phosphates may precipitate out of the lubricant solution if the containers were exposed to cold temperature. Materials such as sodium bicarbonate, urea and morpholine are very soluble in cold water but do not have good buffering capability since their 1% pH values are close to 8.

What is claimed is:

1. A method of lubricating a moving surface in the presence of an acidic beverage, the method comprising:

a) providing a concentrate lubricant composition comprising i) a fatty acid;

ii) a neutralization agent; and iii) a soluble pH buffer selected from the group consisting of carbonate, bicarbonate, citrate, amine selected from the group consisting of urea and morpholine, and mixtures thereof;

b) mixing the concentrate with a carrier to form a dilute lubricant composition; and c) applying the dilute lubricant composition to a moving surface.

2. The method of claim 1, wherein a) the fatty acid is present in the concentrate at about 0.5 to about 99 wt. % of the total weight;

b) the neutralization agent is present in the concentrate at about 0.1 to about 26 wt. % of the total weight; and c) the pH buffer is present in the concentrate at about 0.1 to about 20 wt. % of the total weight.

3. The method of claim 1, wherein the fatty acid, neutralization agent, and pH buffer are food additives.

4. The method of claim 1, wherein the carbonate is selected from the group consisting of sodium carbonate, potassium carbonate, sesquicarbonate, and mixtures thereof.

5. The method of claim 1, wherein the carrier is water.

6. The method of claim 1, wherein the concentrate further comprises an additional functional ingredient.

7. The method of claim 6, wherein the additional functional ingredient is selected from the group consisting of a polyalkylene glycol polymer, a surfactant, a stabilizing agent, a coupling agent, an antimicrobial agent, a viscosity modifier, a sequestrant, and mixtures thereof.

8. A dilute lubricant composition comprising:

a) a fatty acid;

b) a neutralization agent;

c) a soluble pH buffer selected from the group consisting of carbonate, bicarbonate, citrate, amine selected from the group consisting of urea and morpholine, and mixtures thereof; and d) a carrier.

9. The composition of claim 8, wherein the fatty acid, neutralization agent, and pH buffer are food additives.

10. The composition of claim 8, wherein the carbonate is selected from the group consisting of sodium carbonate, potassium carbonate, sesquicarbonate, and mixtures thereof.

11. The composition of claim 8, wherein the carrier is water.

12. The composition of claim 8, wherein the composition further comprises an additional functional ingredient.

13. The composition of claim 12, wherein the additional functional ingredient is selected from the group consisting of a polyalkylene glycol polymer, a surfactant, a stabilizing agent, a coupling agent, an antimicrobial agent, a viscosity modifier, a sequestrant, and mixtures thereof.

14. A concentrate lubricant composition comprising:

a) a fatty acid;

b) a neutralization agent; and c) a soluble pH buffer selected from the group consisting of carbonate, bicarbonate, citrate, amine selected from the group consisting of urea and morpholine, and mixtures thereof.

15. A composition of claim 14, wherein the fatty acid, neutralization agent, and pH buffer are food additives.

16. The composition of claim 14, wherein the carbonate is selected from the group consisting of sodium carbonate, potassium carbonate, sesquicarbonate, and mixtures thereof.

17. The composition of claim 14, further comprising a carrier.

18. The composition of claim 17, wherein the carrier is water.

19. The composition of claim 14, wherein the composition further comprises an additional functional ingredient.

20. The composition of claim 19, wherein the additional functional ingredient is selected from the group consisting of a polyalkylene glycol polymer, a surfactant, a stabilizing agent, a coupling agent, an antimicrobial agent, a viscosity modifier, a sequestrant, and mixtures thereof.

21. A method of lubricating a moving surface in the presence of an acidic beverage, the method comprising: applying a dilute lubricant composition to a moving surface, the dilute lubricant composition comprising:

a) a fatty acid;

b) a neutralization agent; and c) a soluble pH buffer selected from the group consisting of carbonate, bicarbonate, citrate, amine selected from the group consisting of urea and morpholine, and mixtures thereof; and d) a carrier.

22. The method of claim 21, wherein the fatty acid, neutralization agent, and pH buffer are food additives.

23. The method of claim 21, wherein the carbonate is selected from the group consisting of sodium carbonate, potassium carbonate, sesquicarbonate, and mixtures thereof.

24. The method of claim 21, wherein the carrier is water.

25. The method of claim 21, wherein the dilute lubricant composition further comprises an additional functional ingredient.

26. The method of claim 25, wherein the additional functional ingredient is selected from the group consisting of a polyalkylene glycol polymer, a surfactant, a stabilizing agent, a coupling agent, an antimicrobial agent, a viscosity modifier, a sequestrant, and mixtures thereof.

* * * * *